US005397377A

United States Patent [19]

Eckert

[11] Patent Number: 5,397,377

[45] Date of Patent: Mar. 14, 1995

[54] MOLTEN METAL FLUXING SYSTEM

[76] Inventor: C. Edward Eckert, 260 Lynn Ann Dr., New Kensington, Pa. 15068

[21] Appl. No.: 176,910

[22] Filed: Jan. 3, 1994

[51] Int. Cl.[6] ..... C22B 21/06

[52] U.S. Cl. ..... 75/680; 75/684; 75/708

[58] Field of Search ..... 75/708, 680, 681, 682, 75/683, 684, 685, 687

[56] References Cited

U.S. PATENT DOCUMENTS

| | | | |
|---|---|---|---|
| 3,227,547 | 1/1966 | Szekely . | |
| 3,791,813 | 2/1974 | Ramachandran et al. . | |
| 3,870,511 | 3/1975 | Szekely . | |
| 4,373,704 | 2/1983 | Pelton . | |
| 4,386,764 | 6/1983 | Claxton | 266/901 |
| 4,556,419 | 12/1985 | Otsuka et al. . | |
| 4,611,790 | 9/1986 | Otsuka et al. . | |
| 4,634,105 | 1/1987 | Withers et al. . | |
| 4,670,050 | 6/1987 | Otsuka et al. . | |
| 4,673,434 | 6/1987 | Withers et al. . | |
| 4,802,656 | 2/1989 | Hudault et al. . | |
| 4,867,422 | 9/1989 | Duenkelmann . | |
| 4,884,786 | 12/1989 | Gillespie | 266/235 |
| 4,898,367 | 2/1990 | Cooper . | |
| 5,160,693 | 11/1992 | Eckert . | |
| 5,294,245 | 3/1994 | Gilbert | 266/235 |

FOREIGN PATENT DOCUMENTS

| | | | |
|---|---|---|---|
| 9202650 | 2/1992 | WIPO | 75/680 |

*Primary Examiner*—Melvyn J. Andrews
*Attorney, Agent, or Firm*—Andrew Alexander

[57] ABSTRACT

An improved process for treating a body of molten metal is disclosed wherein a rotating impeller is used to disperse treatment media in the body. The process comprises the steps of providing a body of molten metal to be treated, the body having an upper region and a lower region, and providing an impeller on a shaft in said body. Treatment media is added to the body and the impeller is rotated to disperse the treatment media in the body. During the process of treating the body, the impeller is moved periodically between the lower portion and the upper portion of the molten metal body to reduce vorticity therein and to improve dispersion of the treatment media.

8 Claims, 1 Drawing Sheet

MOLTEN METAL FLUXING SYSTEM

INTRODUCTION

This invention relates to molten metal such as molten aluminum, and more particularly, it relates to a method and apparatus for dispersing fluxing media such as fluxing gas or salts in molten metal.

In the prior art, numerous systems have been used for dispersing fluxing media in molten metal. Usually the methods employed involve the use of a special impeller design that controls or directs the flow of metal or disperse fluxing gas more efficiently. For example, U.S. Pat. No. 4,611,790 discloses a hollow rotary shaft having a rotor with radial grooves extending from a gas outlet to the peripheral surface of the rotor, the grooves designed for delivering gas to the melt. U.S. Pat. No. 4,426,068 discloses a cylindrical rotor equipped with blades immersed in a bath and connected to a hollow control shaft for the supply of gas wherein the rotor is pierced by oblique ducts coupled to radial ducts in which metal and gas circulate respectively prior to emanating in the bath to form a fine dispersion. Rotary degassers are also disclosed in U.S. Pat. Nos. 3,791 813; 3,227,547; 4,673,434; 4,373,704; 4,867,422; 4,898,367; 4,802,656; 4,556,419; 3,870,511; 4,670,050 and 4,634,105. However, these methods are not without problems. The rotating impeller often creates a vortex about the shaft as molten metal swirls or circulates about the impeller shaft at a rate approaching the rotation speed of the impeller, defeating the fluxing process. Dross or skim on the surface can be ingested by the vortex. Also, fluxing media added to the molten metal tends to circulate with the molten metal with only minimal dispersion. Further, the vortex has the effect of increasing the surface area of the molten body exposed to air. The increased exposure of the molten metal to air results in an increase in dross formation, subsequent entrainment of the dross and its detrimental collateral effects.

When the fluxing material is a gas, the vortex creates a problem in yet another way. Fluxing gas is displaced towards the center of the vortex by body force separation with the result that other parts of the molten body are not adequately treated with fluxing gas. Thus, the effectiveness of the process is reduced because portions of the molten body do not get treated with fluxing material. In addition, fluxing gas entrained in the molten metal flow pattern tends to coalesce, resulting in larger bubbles of fluxing gas developing in the melt. The larger bubbles lower the effectiveness of the fluxing process because less molten metal gets treated. Thus, there is a great need to maintain the bubbles dispersed in finely divided form and to suppress vortex formation.

Common methods employed to suppress vortex formation include the insertion of baffles or rods into the melt. However, baffles are undesirable because a dead volume develops behind the trailing edges of the baffle. Another method used to suppress vortex formation is to limit power input to the impeller. However, this severely limits efficiency.

These problems continue to plague the industry as indicated in U.S. Pat. No. 5,160,693, for example, which discloses that with rotating impellers a surface vortex forms, the vortex rotating about and flowing downwardly along the impeller shaft, thereby agitating surface dross and drawing impurities back into the melt.

Thus, there is a great need for a more effective fluxing process which suppresses ingestion of dross from the surface back into the melt by vortex formation and aids in dispersing or mixing the fluxing media.

SUMMARY OF THE INVENTION

It is an object of the invention to provide an improved process for introducing a fluxing material to molten metal.

It is another object of the invention to provide an improved process for introducing a fluxing gas to molten aluminum.

It is yet another object of the invention to provide an improved fluxing process using a rotating impeller that minimizes the formation of a vortex and yet maintains fluxing material finely dispersed in the molten metal body.

Still yet it is another object of the invention to provide an improved process for fluxing molten aluminum wherein fluxing gas added to the molten aluminum body is redispersed to maintain the gas in finely divided form.

Still yet another object of the invention is to provide a process wherein improved dispersion of fluxing material is obtained using a translating impeller.

These and other objects will become apparent from a reading of the specification and claims appended hereto.

In accordance with these objects there is provided an improved process for treating a body of molten metal wherein a rotating impeller is used to disperse treatment media in the body. The process comprises the steps of providing a body of molten metal to be treated, the body having an upper region and a lower region and providing an impeller on a shaft in the body. Treatment media is added to the body and the impeller is rotated to disperse the treatment media in the body. During the treatment process, the impeller is moved periodically between the lower portion and the upper portion of the molten metal body to reduce vorticity therein and to improve dispersion or mixing of the treatment media.

BRIEF DESCRIPTION OF THE FIGURE

The Figure is an elevational view in cross section showing a molten metal body having an impeller mounted on a shaft located therein, the impeller capable of being moved between lower and upper regions of the molten metal body.

DETAILED DESCRIPTION OF THE PREFERRED EMBODIMENT

Figure 1:
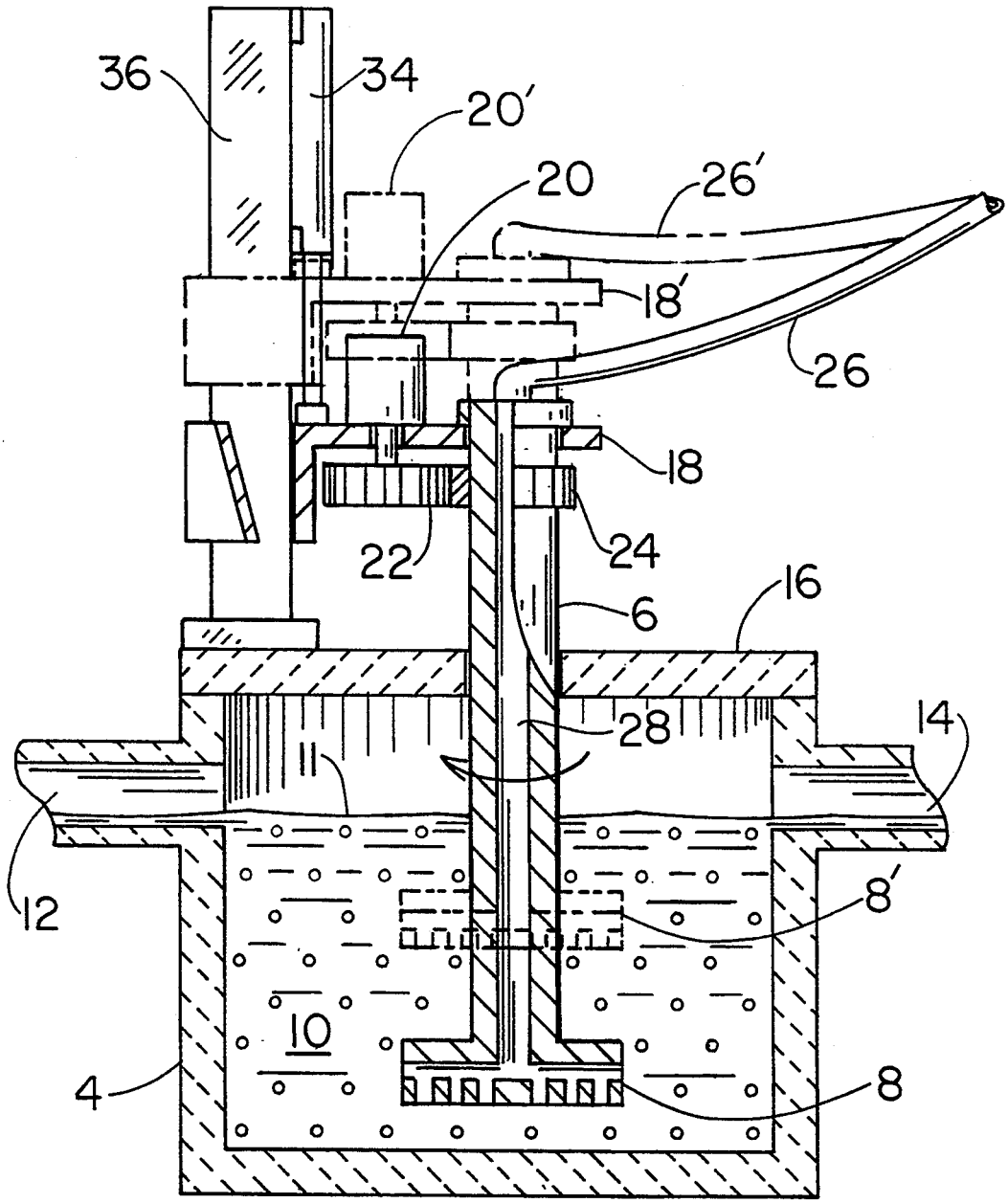

Referring now to the Figure, there is shown an elevational view of a fluxing bay 4 having a hollow shaft 6 and impeller 8. The shaft extends into body 10 of molten metal, e.g., aluminum. Molten metal can be introduced continuously through conduit 12 and removed through conduit 14. Fluxing bay 4 has a cover 16 through which shaft 6 projects. Shaft 6 is carried by structure 18 and is rotated by motor 20 that drives gears 22 which in turn drives gear 24 mounted on shaft 6. Fluxing gas is added through tube 26 and down conduit 28 in shaft 6 before being dispersed through tubes or conduits in impeller 8 into molten metal 10. Fluxing gas may be added to molten metal 10 through porous plugs (not shown) in the wall of bay 4 or through tubes (not shown). The fluxing gas may be injected adjacent impeller 8 for dispersing through the melt.

Fluxing gases that can be used for molten aluminum in the present invention include nitrogen containing gases, carbon containing gases, e.g., fluorocarbons, halogen gases and the so-called inert gases; namely, helium, neon, argon, krypton, xenon, along with nitrogen, carbon dioxide and mixtures of these gases. In addition, chlorinaceous gases such as chlorine may be used individually or combined with the above gases. Gas fluxing can be performed in batch or on a continuous basis. On a continuous basis, molten metal enters along conduit 12 and leaves by channel 14 after fluxing has taken place.

The fluxing process removes both dissolved and suspended impurities, including oxides, nitrides, carbides and carbonates of the molten metal and alloying elements. The dissolved impurities include both dissolved gases and dissolved solids. Dissolved gases in molten aluminum, for example, include hydrogen, and dissolved solid particles include alkali elements such as sodium and calcium. When chlorine gas is added, for example, it forms the chloride salt of the impurity which rises to the surface and is removed. Suspended solids are transported to the melt surface by attachment to rising gas bubbles. Hydrogen is removed by desorption into the gas bubbles and is removed. Thus, it is important to keep a fine dispersion of fluxing gas or fluxing salt distributed throughout the melt in order to provide many sites for collection and removal of both dissolved and suspended impurities.

In accordance with the invention, it has been discovered that as fluxing gas is introduced in a fine dispersion of bubbles to the body of molten metal 10, such fine dispersion of bubbles coagulate or coalesce as they migrate towards surface 11 to form larger bubbles. The coalescence of large bubbles results in the upper region of the melt being less effectively fluxed. The population of larger bubbles provides less sites for removal of impurities than a population of a fine dispersion of bubbles based on the same volume of fluxing gas. For example, as seen by the melt, particularly in the upper region, there is much less bubble surface area into which hydrogen can desorp or onto which suspended solids can attach for transportation to the surface. That is, large bubbles provide fewer sites for collection and removal of both dissolved and suspended impurities. Thus, it is desirable to redispersing larger bubbles in the upper region into a dispersion of bubbles. It has been discovered that this can be accomplished by periodically moving the impeller from lower regions (impeller 8 shown by solid lines) to upper regions (impeller 8' shown by dotted lines). Thus, for purposes of the invention, the impeller is cycled between these regions for improved fluxing.

Cycling between lower regions and upper regions of the melt may be accomplished by means-of structure 8 and hydraulic or pneumatic device 34. Pneumatic device 34 is attached to vertical member 36 mounted on cover 16. It will be appreciated that vertical member 36 may be attached to a ceiling structural member or crane (not shown) that permits withdrawal of impeller 8, cover 16 along with vertical member 36 for purposes of inspecting or replacing impeller 8 or shaft 6. Further, member 18 is attached in sliding arrangement with vertical member 36. Pneumatic cylinder 34 may be connected to a control panel to control or program cycling or translating the impeller between the lower and upper regions of the melt bay. Further, the control panel may be connected to motor 20 and to a source of fluxing media (not shown) introduced along line 26 to synchronize the rotating speed of impeller 8, the flow of fluxing media to the melt and the translating movement of impeller 8 to maximize fluxing and removal of constituents from the melt.

For purposes of the invention, bay 4 has a lower region that can constitute the lower half of the bay and an upper region that can constitute the upper region of the bay. For purposes of distributing fluxing media, impeller 8 (show in solid lines) is rotated in the lower region to distribute fluxing media. When the fluxing media is gas, the gas may be introduced down conduct 28 to emanate from slots in impeller 8. When the gas emanates from the impeller into the melt, it is usually distributed in the lower region in finely divided bubble form by the shear force encountered between the impeller and the melt. Different impeller configurations have been used or suggested to maximize distribution in the lower region of bay 4.

For purposes of distributing gas in the metal in the lower region, impeller 8 is usually rotated at a speed in the range of 100 to 850 rpm and typically 200 to 450 rpm. The rate of rotation should be sufficiently high to create a shear force between the impeller and the molten metal to provide finely divided bubbles of fluxing gas. While the impeller is rotating in the lower region, fluxing gas emanates therefrom typically at a rate in the range of 5 SCF/hr to 425 SCF/hr depending to some extent on the fluxing operation. After the fluxing operation has been carried out in the lower region for a time period of 10 seconds to 5 minutes, impeller 8 is moved upwardly to the upper region where the impeller is denoted as 8'.

During translation from the lower region to the upper region, the impeller can continue to rotate. If the impeller is rotated during translation, fluxing gas can continue to be dispersed into the molten metal. Preferably, the impeller is not rotated, and preferably fluxing gas is not fed to the impeller during translation. Once the impeller is located in the upper region, rotation thereof is initiated. Rotation of the impeller in the upper region has the effect of redistributing bubbles of gas that have coalesced to provide for further contacting of molten metal with smaller gas bubbles in the upper region for more efficient fluxing. Further, preferably, the rate of rotation of impeller 8' is slower than the rate of rotation in the lower region. Thus, preferably, impeller 8' is rotated at a speed in the range of 25 to 600 rpm, and typically 50 to 375 rpm. Further, it is preferred that fluxing gas is not added while impeller 8' is rotating in the upper region. Also, it is preferred that the duration of rotation in the upper region is sufficiently long to enable redistribution of the fluxing gas. Typically the period of rotation in the upper region is in the range of 10 seconds to 280 seconds. Thereafter, once redistribution has occurred, the impeller is translated to the lower region. Preferably, rotation is continued as the impeller is translated to the lower region. If the introduction of fluxing gas was stopped in the upper region, it may start as the impeller is moved downwardly or it can be started when the impeller reaches the lower region.

Preferably, the impeller is lowered to the lower region at a rate which does not disturb surface 11 to an extent that it ingests skim or exposes new surface to cause further oxidation. Thus, the impeller should be lowered at a rate of 3 to 600 inches/minute.

The present invention has the advantage that less processing time is required to remove dissolved or suspended solids or gases. Further, another advantage resides in the fact that less fluxing media is required. While the invention has been described with respect to fluxing gas, it will be understood that it applies to distribution and dispersion of other fluxing media, for example, fluxing salts such as sodium chloride, potassium chloride or cryolite and the like.

While the process of the invention can be carried out by most impellets, a highly suitable impeller useful in the present invention is described in U.S. Pat. No. 5,160,693 which is incorporated herein by reference.

While the invention has been described in terms of preferred embodiments, the claims appended hereto are intended to encompass other embodiments which fall within the spirit of the invention.

What is claimed is:

1. An improved process for treating a body of molten metal wherein a rotating impeller is used to disperse treatment media in the body, the process comprising the steps of:

(a) providing a body of molten metal to be treated, the body having an upper region and a lower region;

(b) providing an impeller on a shaft in said body;

(c) adding treatment media to said body;

(d) rotating said impeller at 100 to 850 rpm when said impeller is positioned in the lower region to disperse said treatment media in said body of molten metal; and (e) moving said impeller periodically between said lower portion and said upper portion of said molten metal body to reduce vorticity therein and to improve dispersion of said treatment media.

2. The process in accordance with claim 1 further including rotating said impeller at a rate in the range of 50 to 375 rpm when said impeller is located in said upper region.

3. The process in accordance with claim 1 wherein said treatment media is a fluxing gas.

4. The process in accordance with claim 1 wherein said treatment media is a salt.

5. The process in accordance with claim 1 wherein said treatment media is a fluxing gas, further including the step of introducing said fluxing gas through said shaft and impeller.

6. The process in accordance with claim 1 further including moving said impeller between said lower region and upper region at least every 10 minutes.

7. The process in accordance with claim 1 further including rotating said impeller at a speed higher when said impeller is located in said lower region than when said impeller is positioned in said upper region.

8. An improved process for treating a body of molten aluminum wherein a rotating impeller is used to disperse treatment media in the body, the process comprising the steps of:

(a) providing a body of molten aluminum to be treated, the body having an upper region and a lower region;

(b) providing an impeller on a shaft in said body;

(c) adding fluxing gas to said body through said shaft and impeller;

(d) rotating said impeller at 100 to 850 rpm when said impeller is positioned in the lower region to disperse said fluxing gas in said body of molten aluminum;

(e) moving said impeller between said lower portion and said upper portion of said molten aluminum body at least every 10 minutes to reduce vorticity therein and to improve dispersion of said treatment media; and (f) ceasing flow of said fluxing gas to said body when said impeller is in said upper region.

* * * * *